US010488147B2

(12) United States Patent
Tremblay et al.

(10) Patent No.: US 10,488,147 B2
(45) Date of Patent: Nov. 26, 2019

(54) ELECTRIC PROJECTION WEAPON SYSTEM

(71) Applicants: Simon Tremblay, Quebec (CA); Eric Bharucha, Quebec (CA)

(72) Inventors: Simon Tremblay, Quebec (CA); Eric Bharucha, Quebec (CA)

( * ) Notice: Subject to any disclaimer, the term of this patent is extended or adjusted under 35 U.S.C. 154(b) by 0 days.

(21) Appl. No.: 15/407,249

(22) Filed: Jan. 16, 2017

(65) Prior Publication Data

US 2018/0187999 A1 Jul. 5, 2018

(30) Foreign Application Priority Data

Feb. 24, 2016 (CA) ..... 2 921 708

(51) Int. Cl.

| | |
|---|---|
| ***F41B 9/00*** | (2006.01) |
| ***F41H 13/00*** | (2006.01) |
| *F41H 9/10* | (2006.01) |
| *F41B 15/04* | (2006.01) |

(52) U.S. Cl.

CPC ..... *F41B 9/0075* (2013.01); *F41B 9/00* (2013.01); *F41B 9/0037* (2013.01); *F41H 13/0037* (2013.01); *F41B 15/04* (2013.01); *F41H 9/10* (2013.01); *F41H 13/0018* (2013.01); *F41H 13/0025* (2013.01); *F41H 13/0031* (2013.01)

(58) Field of Classification Search

USPC ..... 361/232

See application file for complete search history.

(56) References Cited

U.S. PATENT DOCUMENTS

| | | | |
|---|---|---|---|
| 1,497,244 | A | 6/1924 | Mattox |
| 2,331,388 | A | 10/1943 | Graham |
| 2,586,256 | A | 2/1952 | Quarles |
| 2,851,094 | A | 9/1958 | Griffin |
| 3,374,708 | A | 3/1968 | Wall |
| 3,803,463 | A | 4/1974 | Cover |
| 3,971,292 | A | 7/1976 | Paniagua |
| 4,022,350 | A | 5/1977 | Amron |
| 4,034,497 | A | 7/1977 | Yanda |
| 4,154,375 | A | 5/1979 | Bippus |
| 4,443,906 | A | 4/1984 | Tucker et al. |

(Continued)

FOREIGN PATENT DOCUMENTS

| | | |
|---|---|---|
| CA | 2233326 A1 | 4/1997 |
| CN | 2048953 U | 12/1989 |

(Continued)

*Primary Examiner* — Danny Nguyen
(74) *Attorney, Agent, or Firm* — Price Heneveld LLP

(57) ABSTRACT

An electric projection weapon system is provided. The weapon system includes a targeting system for projecting conductive fluid beams towards a focal point at a target location in space. The electric projection weapon comprises at least two nozzles configured to project the conductive fluid beams towards the focal point. At least one of the nozzles is actuated by a nozzle actuator and is directionally controlled to control convergence of the conductive fluid beams towards the focal point. The weapon includes isolated pressurized reservoirs in fluid communication with the nozzles and containing a high conductance ionic solution, forming the fluid beams when projected from the nozzles. A high voltage power supply applies an electric potential difference between the conductive fluid beams.

21 Claims, 14 Drawing Sheets

(56) References Cited

U.S. PATENT DOCUMENTS

| | | | | |
|---|---|---|---|---|
| 4,492,318 | A | 1/1985 | Luk | |
| 4,518,118 | A | 5/1985 | Takata | |
| 4,615,488 | A | 10/1986 | Sands | |
| 4,684,062 | A | 8/1987 | Bagwell | |
| 4,691,264 | A | 9/1987 | Schaffhauser et al. | |
| 4,704,942 | A | 11/1987 | Barditch | |
| 4,706,848 | A | 11/1987 | D'Andrade | |
| 4,735,239 | A | 4/1988 | Salmon et al. | |
| 4,765,510 | A | 8/1988 | Rende | |
| 4,846,044 | A | 7/1989 | Lahr | |
| 4,852,454 | A | 8/1989 | Batchelder | |
| 4,930,392 | A | 6/1990 | Wilson | |
| 5,054,959 | A | 10/1991 | Wilson et al. | |
| 5,103,366 | A | 4/1992 | Battochi | |
| 5,169,065 | A | 12/1992 | Bloch | |
| 5,225,623 | A | 7/1993 | Krasnow | |
| 5,409,638 | A | 4/1995 | Battochi | |
| 5,625,525 | A | 4/1997 | Coakley et al. | |
| 5,675,103 | A * | 10/1997 | Herr | F41B 15/04 361/213 |
| 5,779,099 | A | 7/1998 | D'Andrade | |
| 6,151,824 | A | 11/2000 | Clayton | |
| 6,431,044 | B2 * | 8/2002 | Poole | F41H 9/10 362/102 |
| 6,771,186 | B1 * | 8/2004 | Boveja | B64D 45/0015 244/118.5 |
| 7,675,731 | B2 * | 3/2010 | Bitar | F41H 11/12 361/232 |
| 7,676,972 | B2 * | 3/2010 | Smith | F41B 9/0031 361/232 |
| 2003/0151880 | A1 | 8/2003 | Lee | |
| 2009/0183413 | A1 | 7/2009 | Smith et al. | |
| 2009/0237857 | A1 | 9/2009 | Kao | |
| 2016/0265868 | A1 * | 9/2016 | Forsythe | F41B 9/009 |

FOREIGN PATENT DOCUMENTS

| | | | |
|---|---|---|---|
| CN | 2053322 | U | 2/1990 |
| CN | 2053323 | U | 2/1990 |
| CN | 1040431 | A | 3/1990 |
| CN | 2081521 | U | 7/1991 |
| CN | 1053674 | A | 8/1991 |
| CN | 2082390 | U | 8/1991 |
| CN | 2098665 | U | 3/1992 |
| CN | 2108889 | U | 7/1992 |
| CN | 2135137 | Y | 6/1993 |
| CN | 2147505 | Y | 11/1993 |
| CN | 1080393 | A | 1/1994 |
| CN | 2177220 | Y | 9/1994 |
| CN | 2498575 | Y | 7/2002 |
| CN | 2684135 | Y | 3/2005 |
| CN | 2694217 | Y | 4/2005 |
| CN | 2807185 | Y | 8/2006 |
| CN | 101082473 | A | 12/2007 |
| CN | 201355222 | Y | 12/2009 |
| CN | 202501799 | U | 10/2012 |
| DE | 2654498 | A1 | 6/1978 |
| DE | 3917167 | A1 | 11/1990 |
| DE | 19824541 | | 8/1999 |
| DE | 19824541 | A1 | 8/1999 |
| EP | 0010561 | A1 | 5/1980 |
| EP | 0326268 | A2 | 8/1989 |
| EP | 0198728 | A1 | 11/1989 |
| EP | 0441610 | A1 | 8/1991 |
| EP | 0303198 | A1 | 10/1991 |
| EP | 1901025 | A2 | 3/2008 |
| WO | 9712194 | A1 | 4/1997 |

* cited by examiner

ELECTRIC PROJECTION WEAPON SYSTEM

SUMMARY

The system differs from all previous devices by incorporating at least one directionally controlled nozzle to create a controlled impedance intersection point at the target. This provides a novel feature for precisely controlling the distance at which the effect of the weapon (shock) occurs.

By setting up this condition rapidly and/or by combining multiple media steams, a raster much like the type used to form an old fashioned CRT television image can be used to create invisible electrified fences, walls and or 3D structures like cages.

Another improvement is the possible use of a modulating viscosity of the medium. By using the unique physical properties of some compounds that change their viscosity in a fast and defined way, fluid exit conductivity and breakdown can be controlled. Examples of viscosity modulation can be achieved via thermal, electromagnetic fields or other means. The system is designed to maintain the medium in a thinner (liquid like) state inside the device while making it thicker (gel or solid like) when propelled outside. This partial or total material phase change contributes to extend the continuous laminar jet length (the length without forming droplets) and thus providing an improved conductive medium path for electric current allowing the reach of more distant targets.

The media are typically water ionic gel solutions or very low melting point alloys. It is projected through a small diameter long metal tube that provides laminar flow, slowly coerced and then exited at high velocity. The generated streams join within breakdown voltage at the target and a shock of controllable power can be imparted on the target (subject).

Unlike previous patents (patents U.S. Pat. Nos. 5,169,065 and 7,676,972B2) the two streams of fluid are not projected in parallel or uncontrolled lines; those patents also never made use of controlled viscosity to provoke quasi or total phase to solid once in the air.

BACKGROUND

Solutions containing salts or acids are known to be conductive. For example a car battery's electrolyte is highly conductive. In this invention, we use this same basic liquid conductivity principle, but at a much lower and thus safer concentration. Unlike a car battery, the preferred embodiment uses higher voltages and a fluid medium that is only temporarily projected.

The acceptance of electric weapons by law enforcement is well established in many countries because it is an effective and a non-lethal means for control and neutralization of a threat. It is simple to use, causes virtually no collateral damage, and is relatively accurate. Despite obvious advantages some aspects of existing systems are operationally challenging. In current embodiments reloading is not possible or practical without full service (based on projected wire conductor and springs). Furthermore its use is more constraining in crowded areas given wire deployment along in a linear path (like a bullet's trajectory).

The invention overcomes these drawbacks by providing multiple shots, enables the capability of multiple or continuous reloading (through refueling of physical medium fluid/solution) and can target only in a controlled spatial volume (though jet convergence). This opens new possibilities for standalone operation (surveillance and active defense devices) and drone mounting (low recoil).

DESCRIPTION OF THE FIGURES

Other objects, advantages and features will become more apparent upon reading the following non-restrictive description of embodiments thereof, given for the purpose of exemplification only, with reference to the accompanying drawings in which.

The table below presents reference numbers used in at least some of the above-mentioned Figures, with the corresponding component of the electric projection weapon system:

| | |
|---|---|
| 101 | Fixed Nozzle |
| 102 | Mobile Nozzle |
| 103 | Nozzle Actuators |
| 104 | Range finder |
| 105 | HF Inverted polarity rectify |
| 106 | HF Non Inverted polarity rectify |
| 107 | Camera & identity control (optional) |
| 108 | Air humidity & temperature sensor |
| 109 | Power selector |
| 110 | External computer interface |
| 111 | Charger |
| 112 | Battery packs |
| 113 | Main ionic fluid reservoir |
| 114 | Ionic/isolating fluid refilling port |
| 115 | Chemical refilling port |
| 116 | Trigger |
| 117 | Safety lock |
| 118 | I (inverted) polarity output port |
| 119 | N (non inverted) polarity output port |
| 120 | I (inverted) sequence A reservoir |
| 121 | N (non-inverted) sequence A reservoir |
| 122 | Expulsion port (to air) |
| 123 | Inport |
| 124 | I (inverted) sequence B reservoir |
| 125 | N (non inverted) sequence B reservoir |
| 126 | High pressure liquid pump & check valve |
| 127 | Gas pressure regulator |
| 128 | Volumetric pressure generator (piston type) |
| 129 | Volumetric pressure generator (bladder type) |
| 130 | Volumetric pressure generator (piston mechanically driven type) |
| 131 | Gas/fluid pressure generator |
| 132 | Catalyst (3D mesh) |
| 133 | Chemical Reservoir |
| 134 | Pump |
| 135 | Power control loop |
| 136 | Voltage set point |

-continued

| | |
|---|---|
| 137 | Current & voltage monitor |
| 138 | Current limiter |
| 139 | Nozzle cooling elements |
| 140 | Nozzle temperature sensor |
| 141 | Temperature control loop |
| 142 | Reservoir temperature sensor |
| 143 | Reservoir heating element |
| 144 | Target |
| 145 | User |
| 146 | Electric 3 way - purge fluid or admission |
| 147 | Electric pressure sensor |
| 148 | Electromagnetic secondary governor control |
| 149 | Governor valve |
| 150 | Isolating flush fluid reservoir |
| 151 | Replaceable recharge unit |
| 152 | Pump & 3 way selector valve |
| 153 | Mixing chamber |
| 154 | Depressurization valve |
| 155 | High pressure hydraulic oil or isolating gas reservoirs |
| 156 | direct pressurized reservoir s sub system |
| 157 | Indirect pressurized reservoir sub system |
| 158 | Current & voltage control sub system |
| 159 | Optional viscosity control sub system |
| 160 | Nozzles valves |

DETAILED DESCRIPTION AND PRINCIPLE OF OPERATION (PREFERRED EMBODIMENT)

Figure 9:
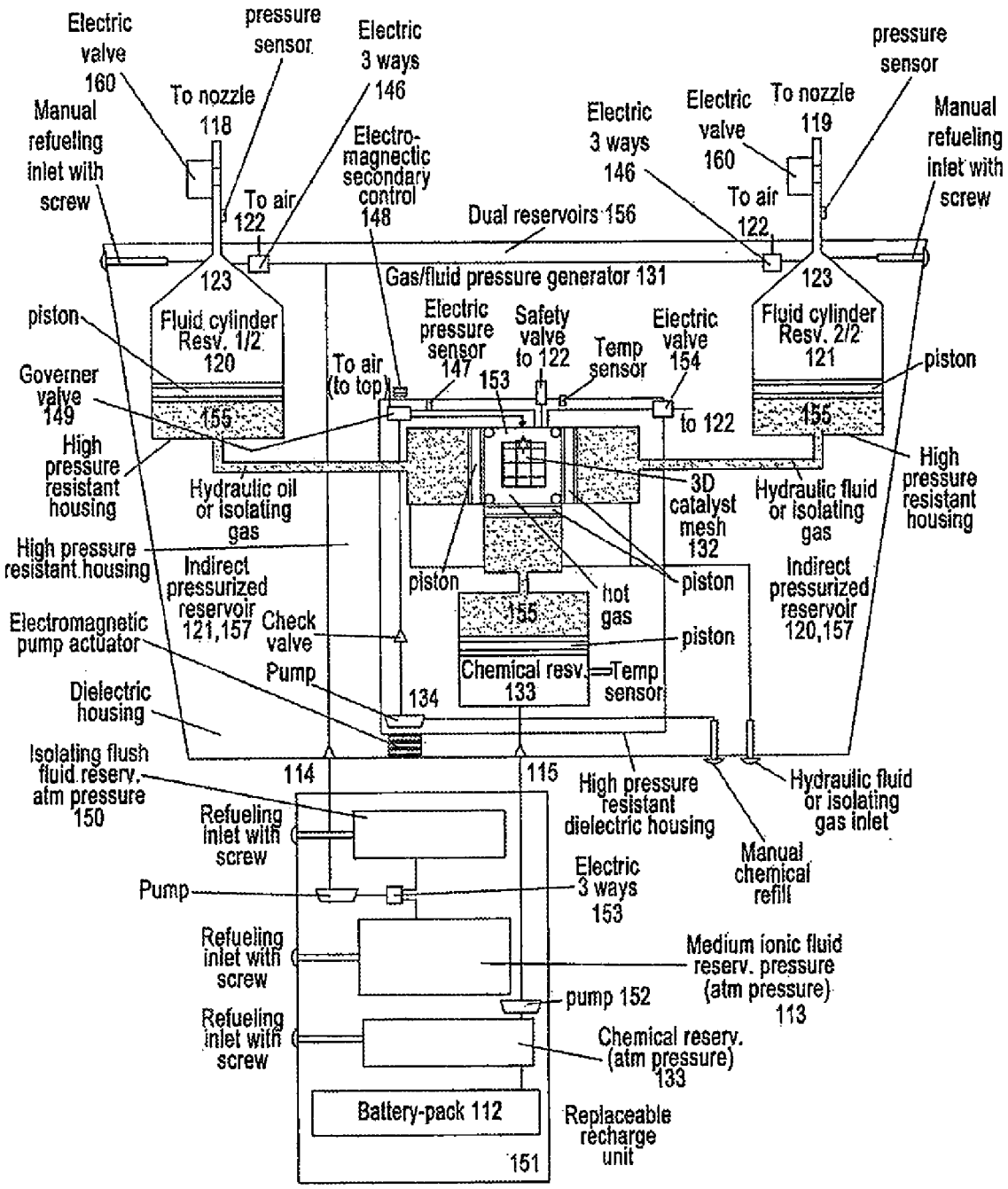
FIG. 9 is a schematic representation of the operation of the electric projection weapon system of FIG. 1, with the electric controls not shown.

1. Operation of the device is depicted on the overall (FIG. 2A to 2C), functional (FIG. 3) and operation (FIG. 9) diagram.
2. Two or four isolated reservoirs (120,121, 124,125) contain special high conductance ionic solutions. Reservoirs can be pressurized directly by a pump or indirectly by a piston or a bladder. See FIGS. (6 through 8).
3. In a direct pressurized reservoir system (156), the fluid is pumped by a high pressure pump (126) and pressure is maintained by a confined inert gas behind a diaphragm (127). The fluid being quasi incompressible forces pressurization of the gas, until the fluid is ready for release. See FIGS. (4 and 6).
4. In an indirect pressurized reservoir system (157), forced volume variation induces a fluid pump pressure. In this case a piston type (128); or a bladder type (129); a gas pressure generator (131) (see points 7 and 8) is used to produce the volume variation. In the case of a mechanically driven piston (130); the drive is achieved with a motor. In such embodiments, the fluid experiences low to high pressure states before release. See FIGS. (5 and 7).
5. More specifically, the indirect pressurized reservoirs (157), the pressure generation can be established with:
   a. Two or four pistons that move fluid from one end from pressure that occurs on the other piston's end (128). See FIG. (7).
   b. Two or four confined bladders move the fluid on one end from pressure variation that occurs between the bladder's membrane and a rigid confinement chamber (129). See FIG. (7).
   c. Two or four pistons that move from a motor armed springs with a magnetic actuated released mechanism through a dielectric connecting rod (130). See FIG. (8).
6. The system contains: a mechanical valve set (122)(149)(146)(153) and a pump set (134)(152)(153) that are used to dispatch fluid (this may also be a gas or oil) for the operation of the dual or quad reservoirs (156,157). The system synchronizes: one high pressure fluid pump (126) or (on an indirect pressurized reservoir sub-system) one gas pressure generator. The valve sequence is driven by the controller (109). See FIGS. (3, 4 and 5).

7. In an indirect pressurized reservoir sub-system, exception made to the mechanically driven piston, the gas pressure generator (131) can be based on:
   a. An air compressor
   b. A pressured gas generated by a
      i. Compressed gas cylinder
      ii. Cryogenic expansion reaction: water solidification for example.
      iii. Or preferably, a chemical reaction (like hydrogen peroxide with a catalyst, see list) See FIG. (9).
8. In a pressured gas generator (131) based on a chemical reaction; a closed loop is used by the controller (109) to maintain the required system's pressure at a high pressure. The high pressures of hydraulic oil (or isolating gas) reservoirs (155) are controlled by modulating in real-time mechanically (149) and/or electronically (148)(147) the amount of chemical that reacts with the catalyst (132) in the mixing chamber (153). A pump (134) with a check valve at its exit or other may be used to control the flow. From the mixing chamber (153) pistons movement, hydraulic oil (or isolating gas) is pressurized (155) and this simultaneously pressurizes both fluid (120)(121) and chemical (133) reservoirs. Heat generated by the reaction may be used to heat the fluid reservoirs (113), the pump and valve (153) and/or to recharge the batteries (112). After several fired shots, the fluid reservoirs (120)(121) are depleted, the controller (109) depressurizes (122) (154) the mixing chamber (153). Then, the low pressure pumps and valve (153)(152) refill both fluid (120)(121) and chemical (133) reservoirs through check valves (114) (115). To prevent short circuiting the reservoir, through the refilling tube, the remaining fluid in transit is later flushed and expulsed throughout ports (122) by valves (146) and pump & valve (153). The electrolyte is replaced by an isolating flush fluid (150). Finally, the gas pressured gas generator (131) is reset again to working status. The port's (122) external output is in the opposite mean direction of firing jets. This prevents unwanted vibrations. See FIGS. (1, 2, 3 and 9).
9. Continuously or alternately when the trigger (116) is pulled half way, the system (109) acquires the target though a range finder (104) or from an external computer that generates a 3D analysis (110) and calculates the required angles for ejector nozzles convergence on the target. See FIGS. (1, 2, 3 and 9).
10. The first nozzle may have a fixed position (101). The second of the ejector nozzle (102) has a computer controlled (109) angular position that sets an intersection point at a set distance between the 2 conductive fluid beams. Alternately both nozzles may be actuated. See FIGS. (1, 2, 3 and 9).
11. Humidity, temperature and pressure are monitored to calculate the actual dielectric breakdown of air (108&109). The applied voltage is modulated accordingly with the addition target distance measurements See FIGS. (1, 3 and 9).
12. Depending on the distance from the target the dispensed volume is calculated by computer (109). Volume controlled is achieved by controlling the pump's (126) or gas pressure generator (131) on-time as the debit is known See FIGS. (1, 3 and 9).
13. Alteration of the focal point is modulated based on the computed air dielectric breakdown and the stream's resistivity that result in a constant voltage at the interception point on the target. See FIGS. (1, 3 and 9).
14. A high voltage power supply (105&106) is used to apply a potential difference between the two streams of liquid which closes the circuit at the dielectric breakdown point on the target (144). See FIGS. (1, 3 and 9).
15. Current & voltage circuits monitor (158) the actual delivered power (137) and adjust the current in real-time (135)(136). Adjustments are conveyed onto the fluid path resulting in the desired effect at the output (144). A redundant secondary control sets the current safety upper limit (138) to a specific setting (minimal, warning, non-lethal shock and lethal shock if allowed by the device power selector (109) and internal configuration). See FIG. (3).
16. An enhancement of jet properties can be achieved by viscosity control. This mechanism can use the thermal properties of a special solution, like a gelatin-salt or on a low melting point metal alloy. By keeping the solution inside the device at a significantly higher temperature than the outside; when propelled out from the nozzle, contact with air cools the media and solidifies the solution into a more viscous fluid thus generating longer continuous jet. Both external (140&108) and internal thermal sensors (142) along with an internal heater (143) can be used in a temperature control loop (141) maintaining the required thermal difference. Also, as a possible enhancement, thermo-electric devices (Peltier junction) or other cooling means (139) can be used on the nozzle and on an anterior portion of tubing to rapidly cool the medium. This initiates and possible completes fluid phase changes prior to nozzle exit. See FIG. (3).
17. The unit can be portable or stationary. Stationary units may provide larger coverage areas due to faster scanning motors and higher possible jet exit velocities. See FIGS. (2, 10 and 12).
18. Multiple simultaneous firing nozzles can be combined for coverage of very large areas.
19. Instead of being completely integrated within the device, the three refilling reservoirs (150)(133)(113), pumps & valves (153)(152) and battery pack (112) may be contained in a sole unit named 'replaceable recharge unit' (151) that is removable and replaced during action to reduce idle time. Also, large external reservoirs of fluid with a pump are used to refill the device's main reservoirs (113)(150)(133). Furthermore these may be used in some applications (along with permanent tubing) to refill the device continuously allowing uninterrupted operation and/or to lower maintenance. See FIGS. (1, 2 and 9).
20. Power is provided onboard with battery packs (112) that optionally can be charged periodically or continually by the charger (111) which may use a fuel cell or thermo-electric generator (TEG) type of generation exploiting the chemical reaction occurring in the gas/fluid pressure generator (131). See FIG. (9).
21. The trigger (116) is used to confirm the target (144) and it is protected by a safety lock (117). The shock power level may the controlled by a selector (109). See FIGS. (2 and 3).

Application and Variants

Hand Held Electro Gun Application

Figure 1:
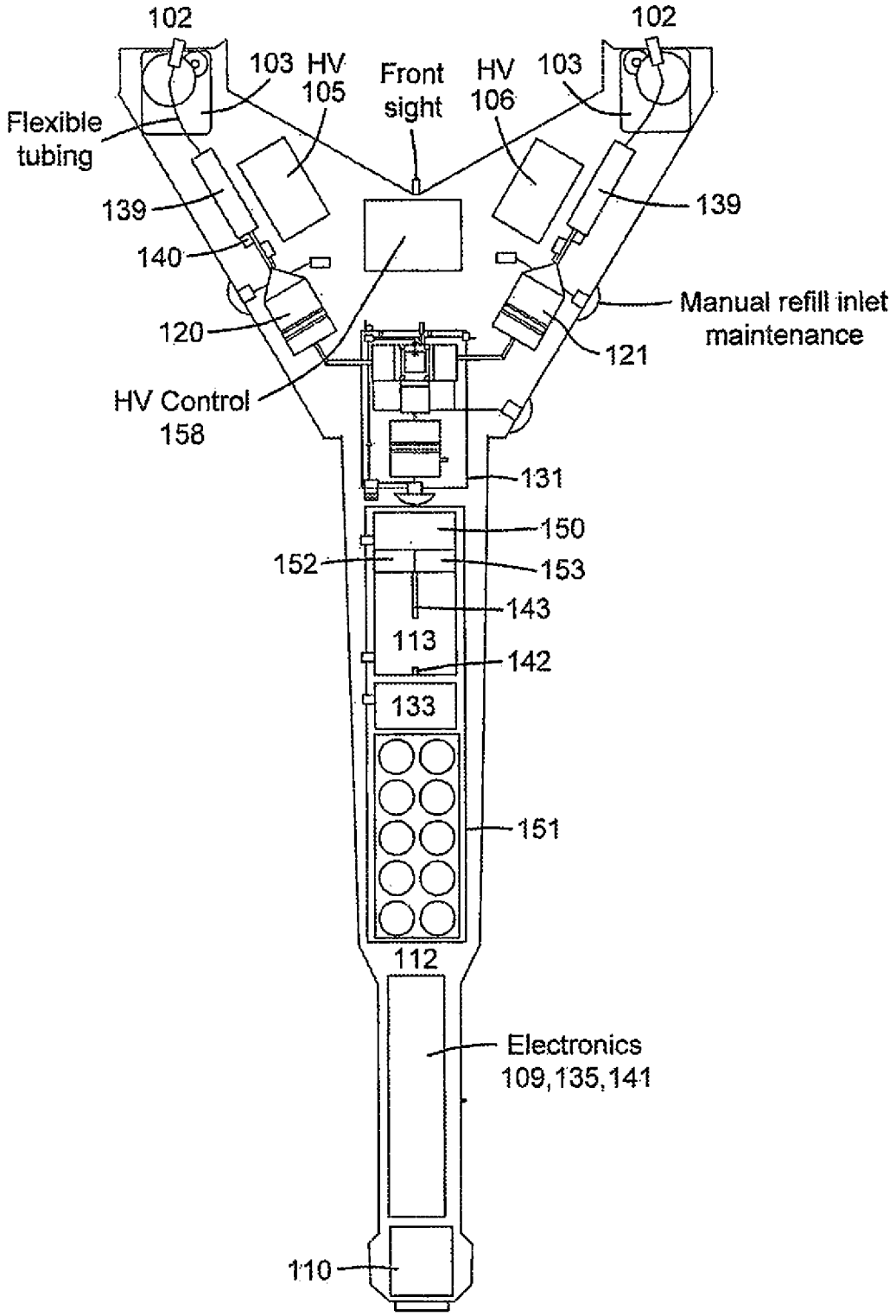
FIG. 1 is a schematic representation of the components of the electric projection weapon system, in accordance with one embodiment.
Figure 2B:
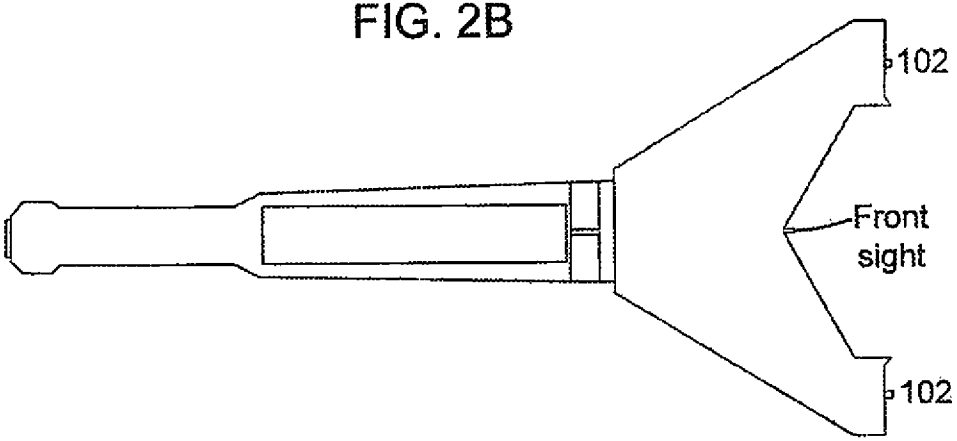
FIGS. 2A to 2C are respectively a top plan view of the weapon system of FIG. 1 shown in a first orientation, a top plan view of the weapon system of FIG. 1 shown in a second orientation and a side elevation view of the electric projection weapon system of FIG. 1.
Figure 2C:
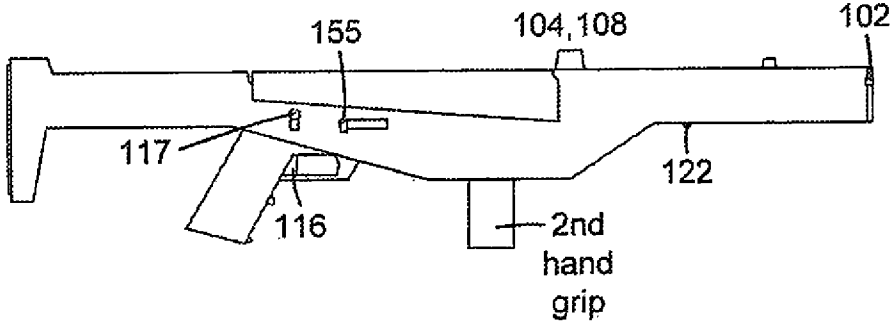
Figure 2A:
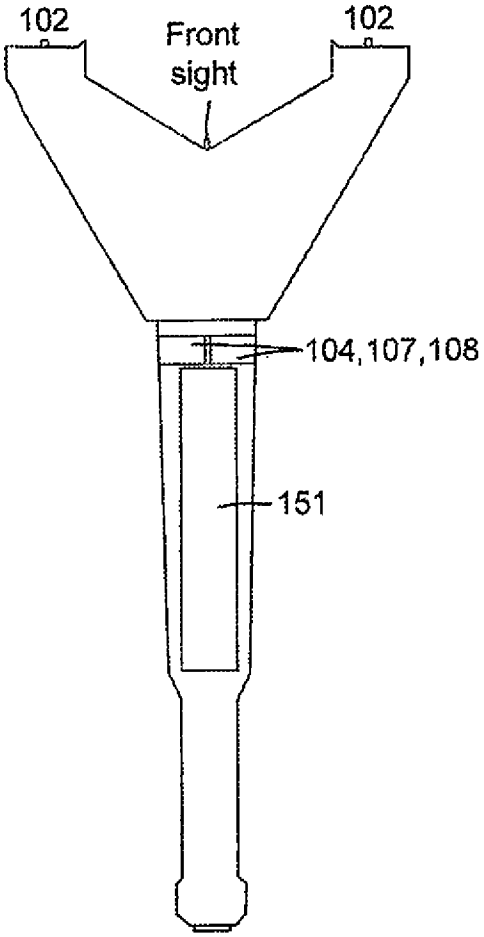
Figure 3:
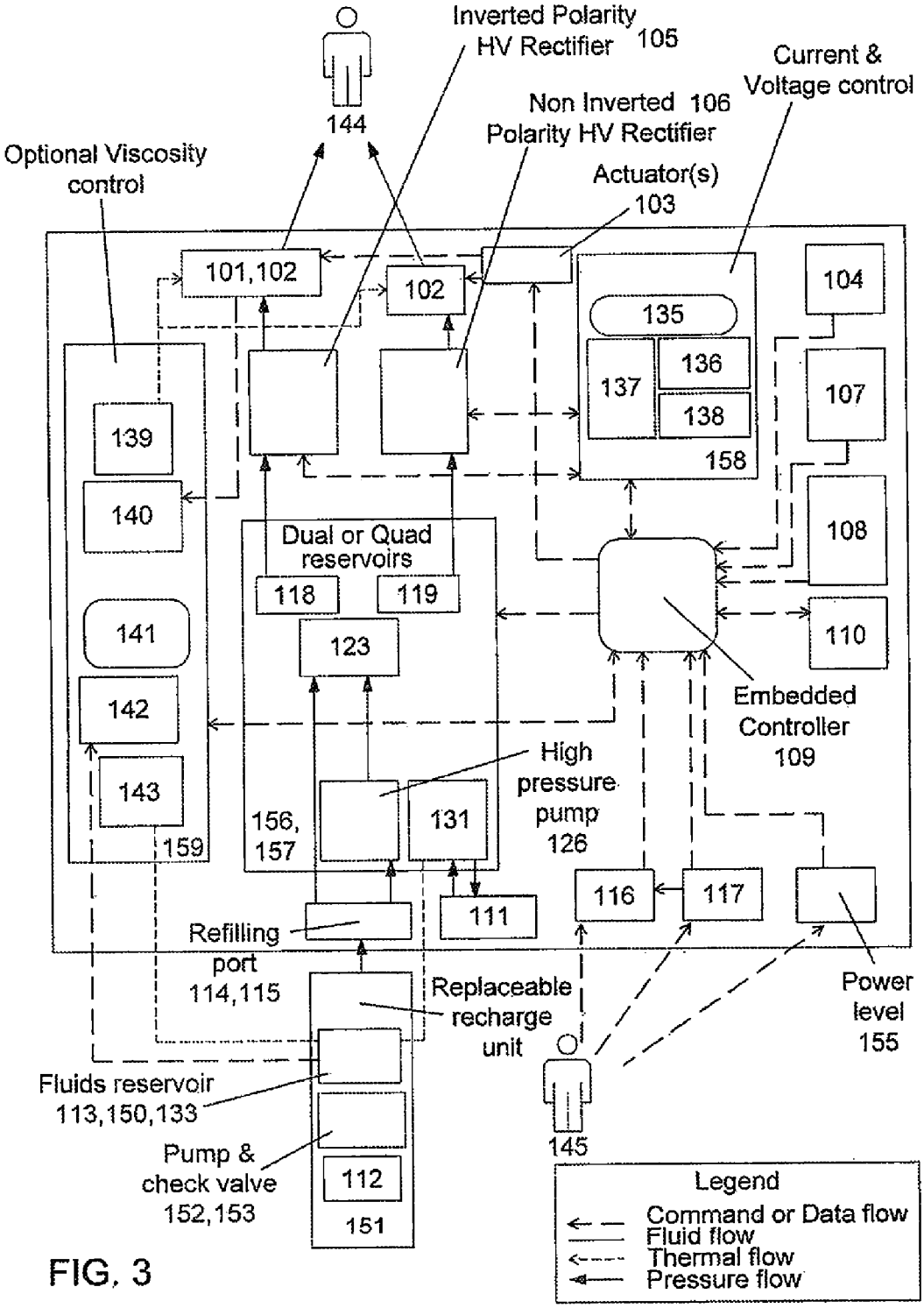
FIG. 3 is a functional diagram of the electric projection weapon system, in accordance with an embodiment.
Figure 4:
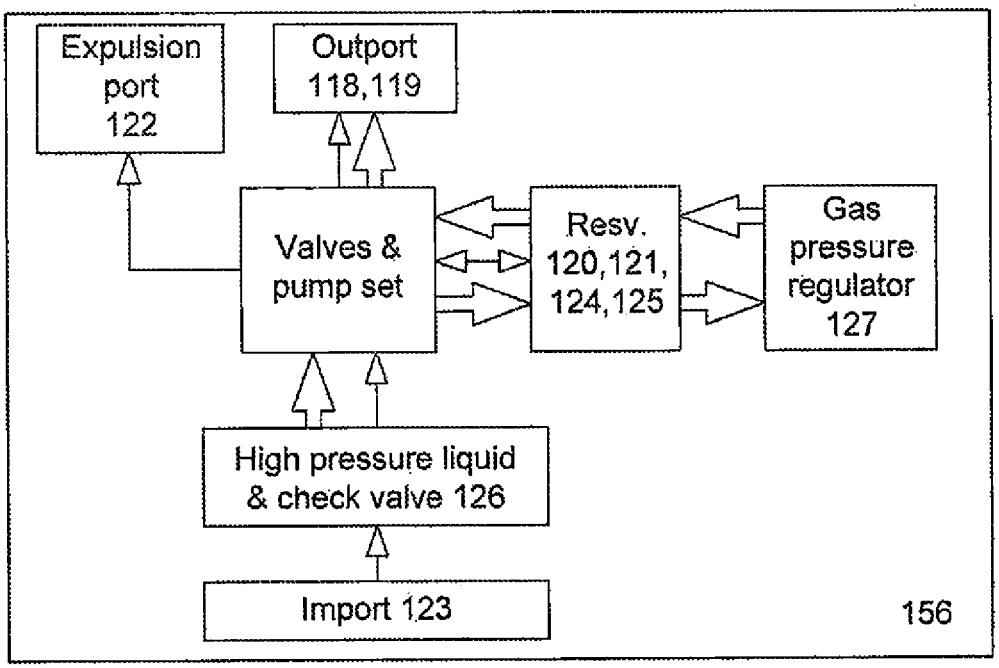
FIG. 4 is a functional diagram of direct pressurized reservoirs of the electric projection weapon system, in accordance with an embodiment.
Figure 5:
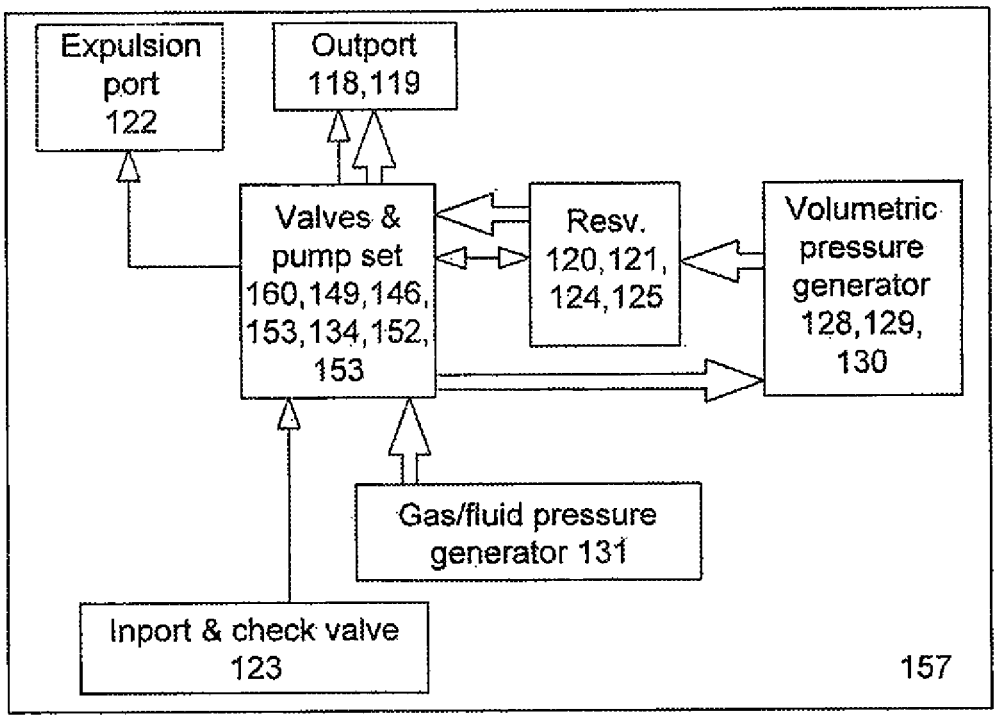
FIG. 5 is a functional diagram of indirect pressurized reservoirs of the electric projection weapon system, in accordance with an embodiment.
Figure 6:
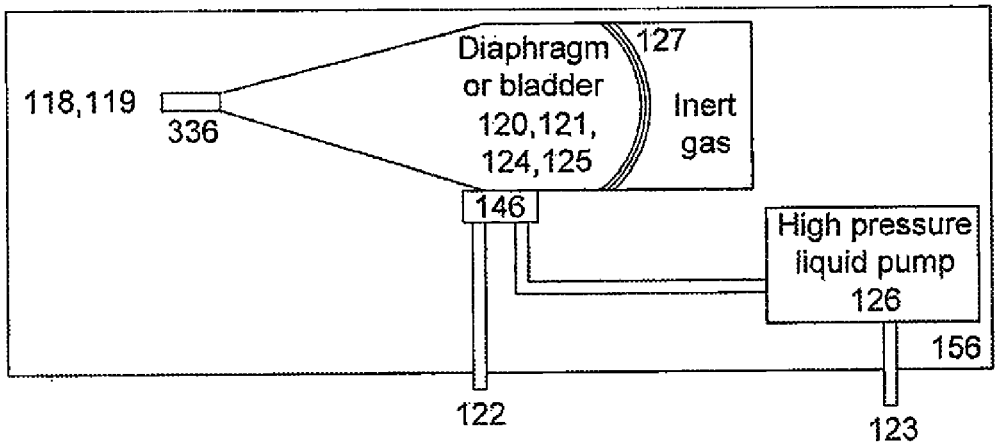
FIG. 6 is a schematic representation of the direct pressurized reservoir, in accordance with an embodiment.
Figure 7:
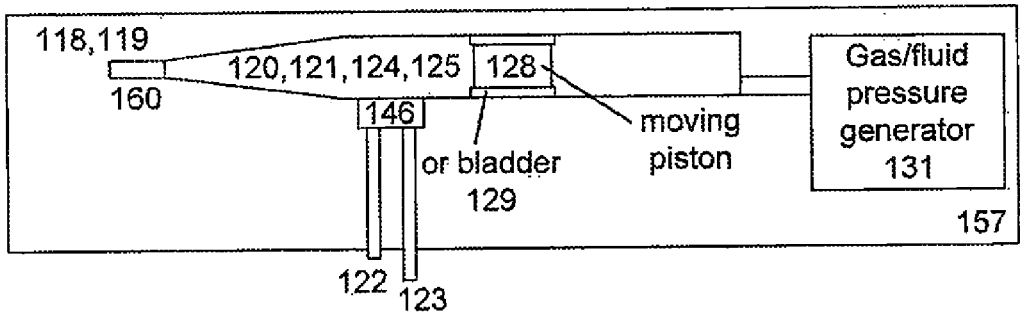
FIG. 7 is a schematic representation of a gas/fluid indirect pressurized reservoir of the piston type, in accordance with an embodiment.
Figure 8:
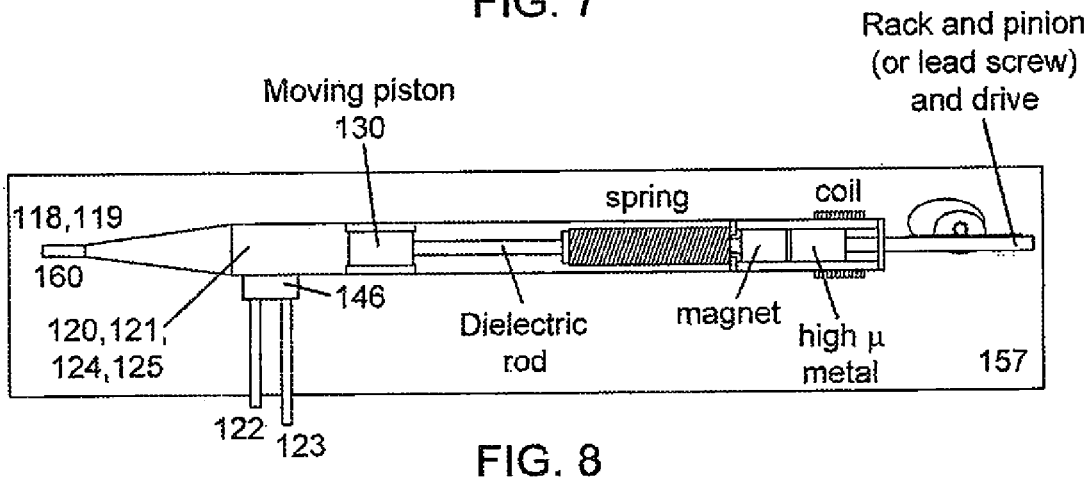
FIG. 8 is a schematic representation of an indirect pressurized reservoir, in accordance with an embodiment where a piston is mechanically driven with a magnetic actuator.

The unit can be mounted in a gun like structure as depicted in FIGS. 2A to 2C.

Computerized Raster Electro Wall Application

Multiple units can be assembled in a matrix or fire in a time shared coverage, rendering the effect of an invisible wall. Such an invisible wall or perimeter may be set and can prevent person(s) or animal(s) from penetrating or leaving a quartered off area. This may be used to fence animals or persons from access to an area or passageway.

The thickness of the said raster wall can be altered by creating high speed rastered points in front of one another rendering the perception and sensation of a controlled thickness.

A collection of range measuring sensors as well as cameras may be used to determine target positions. Multiple units can be synchronized together to dispatch proper target coverage and increase wall coverage resolution.

Such units may be mounted on gimbals or pan & scan mechanism to cover larger areas. Alternately beams may be deflected electrically or magnetically.

Portable Variant

Figure 10:
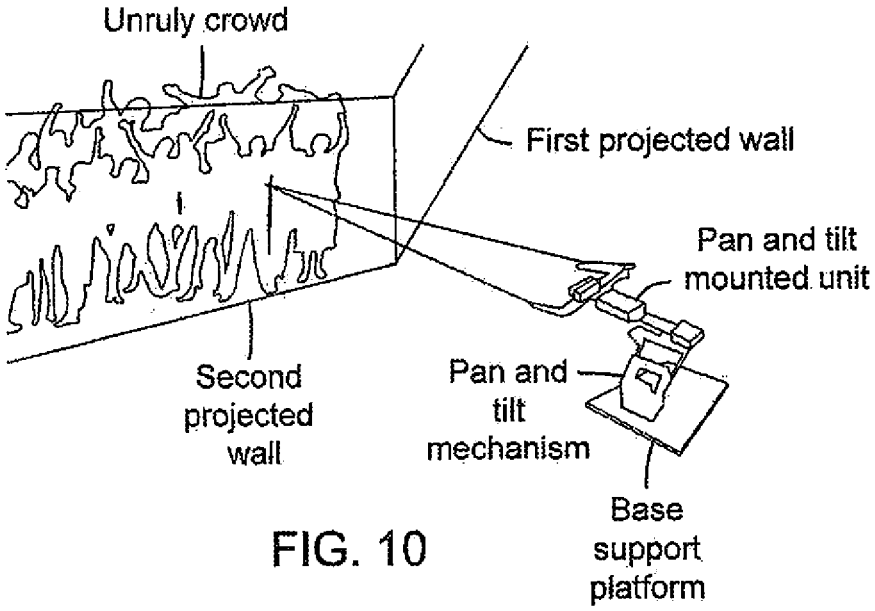
FIG. 10 is a schematic representation of an electric projection weapon system, in accordance with an alternative embodiment where the electric projection weapon system is used as a crowd control system being deployed in a hot zone.

Referring to FIG. 10, portable units could be used by riot police to restrict and contain protestors or for crowd control without the use of rubbers bullets or tear gas canisters pepper spray or other firepower. Target identification by visual or a radio frequency ID ensures that law enforcement personnel don't get shocked by the device. For example and without being limitative, FIG. 10 shows the electric projection weapon system being embodied as a crowd control system and being deployed in a hot zone.

Drone Mounted Variant

Figure 11:
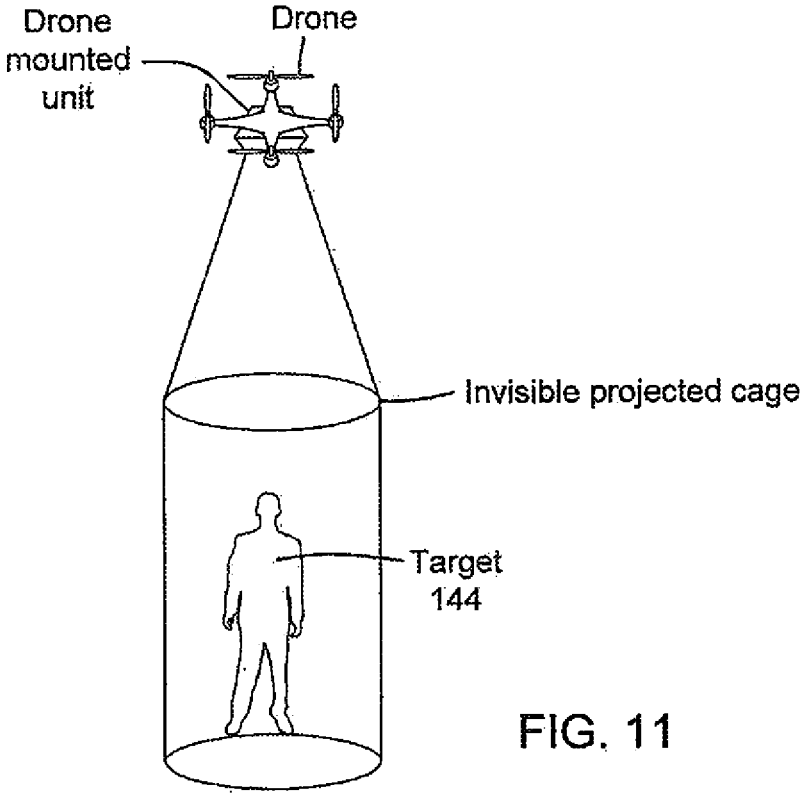
FIG. 11 is a schematic representation of an electric projection weapon system, in accordance with an alternative embodiment where the electric projection weapon system is used for containment of an insurgent for later capture using a drone projected invisible cage.

Referring to FIG. 11, the system may be carried by a drone and used to actively or by remote control shock an enemy or project an invisible cage around a suspect or a dangerous animal who then remains constrained until further intervention can occur. This system has the advantage of having little recoil when fired from a drone. For example and without being limitative, FIG. 11 shows the electric projection weapon system being embodied for containment of an insurgent for later capture using a drone projected invisible cage.

Wall Mounted Surveillance System Variant

Figure 12:
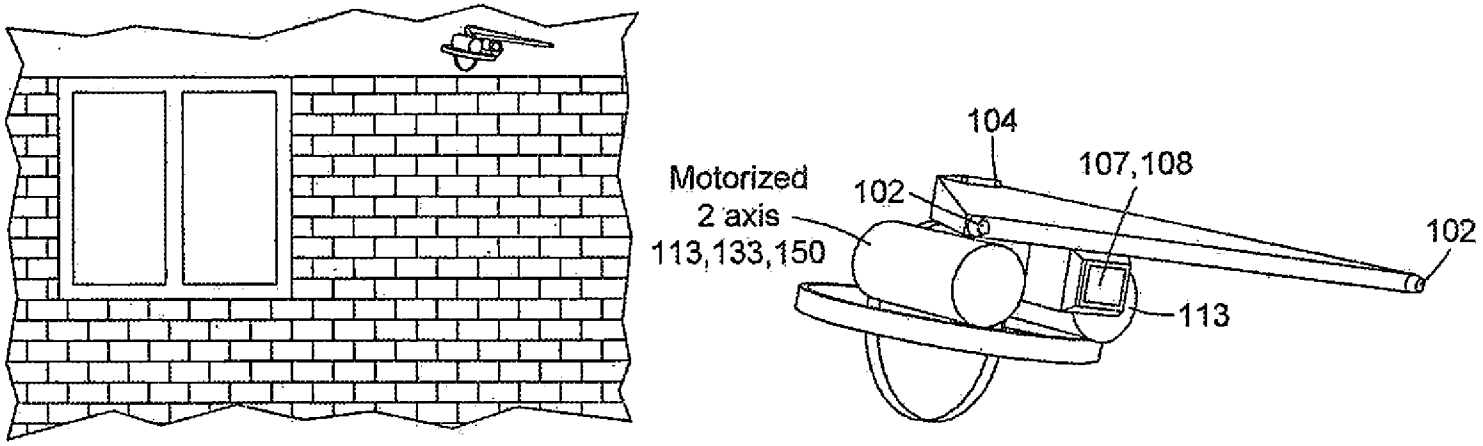
FIG. 12 is a schematic representation of an electric projection weapon system, in accordance with an alternative embodiment where the electric projection weapon system is part of a surveillance system.

Referring to FIG. 12, the unit can be used in conjunction with a surveillance camera with intruder control on private property or high security facilities. This gives the possibility to the surveillance agent to remotely observe a crime in progress. Automatic control can also be used. An identity control such as voice; or facial recognition; or radio identification technology (like RFID) can be used to ensure that is not a false/friendly target. Using an installation which provides standard electric power, network (for camera) along with tubing to an easily accessible large fluid tank, the unit may be operated without the need of access the unit (no ammo or recharging is required). This allows operation as easy as standard surveillance only system and has the benefit of controlling the intruder rather than just seeing him. For example and without being limitative, FIG. 12 shows a wall installation of the unit, therefore adding security to an otherwise vulnerable window.

Explosive or Incendiary Detonated or Ignited at Controlled Distance and Shield Variant An advanced use of this invention may provide new application fields by using large amount of power (lot more than what is required for human shocking) and using a timely sequenced fired electric bolts at high speed, a moving object can be slowed down or stopped by the action of the electric arcing shockwave result of the focal point A series of lightning bolts of high energy in front of a bullet or missile could destroy it, slow it down enough to significantly reduce damage, create a local shield or induce a trajectory change.

Additionally the device may be fitted with a third nozzle that carries an ignitable or explosive material stream which will be ignited by the electrical spark at the target. The ignitable fluid projection may be stopped and with a computed delay before applying the high voltage generator to the conductive fluid in order to make impossible a back firing. The advantages of using the ignitable material is to increase heat damage of the target; multiple shots; and an easy means of reloading a unit (can be made at ground level).

Extended Possible Mechanisms a) Streams of conductive material and of inflammable material may be liquid solid gaseous or a mixture of both. Powdered metals could even be magnetically projected using rail gun type mechanisms, or using a spark chamber.

b) Magnetic or electric fields may be used to coax the ejected jet stream into a well-defined beam of liquid. Electric plates and or magnetic coils may be used to deflect ionized jet onto a trajectory.

c) Viscosity control can be based on special conductive polymer streams that turns into gel in air and/or a lower pressure.

d) An electromagnetic arc propulsion system could be developed. The weapon can then operate in one of 2 ways either by deflection of a current path compensating an inverted or collapsed magnetic field based on Faradaic principles; or by generating a column of plasma that then serves as a conductive medium for a second HV source based on Lorentz force law and electric propulsion.

Figure 13:
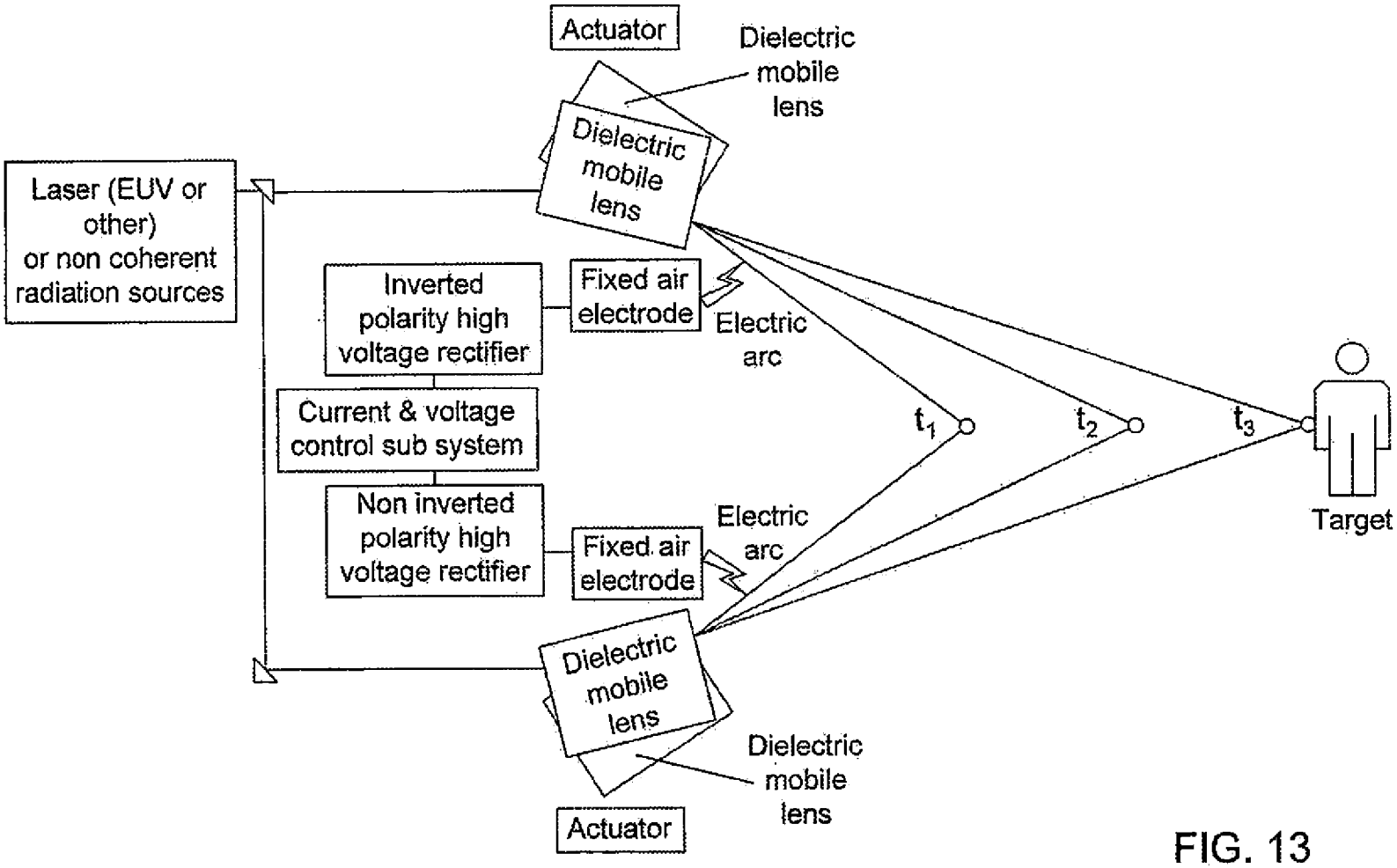
FIG. 13 is a schematic representation of an electric projection weapon system, in accordance with an alternative embodiment in which the system uses a radiation source to ionize air in the path of firing in a sequence of burst that can be directed 3 dimensionally by the meeting of combined energy pulses.

Principally 2 electro-magnetic interactions are at play one is Lenz's law; and the other is the Lorentz force in the presence of orthogonal components of magnetic field and current. (Refer to addendum for additional information).

e) Finally an ionization system in which at least one pair of pulsed radiation (normally lasers) rays combine to join energy at a series of targets arranged in a stream by rapid firing. The lasers have a frequency that matches the spectrum absorption band of one the major atmospheric gas ($O_2$, $N_2$ or Ar) and/or have the $1^{st}$ level direct ionization frequency of such gas. The converged radiation is absorbed as heat or ionization in a stream of air. This creates a lower impedance path for electric arcs. This path can be made directly or increased progressively to angle in a succession of rapid events reaching the target. The arcing beam trajectory that may be modulated along a path in 3-D, which can be curved or straight. FIG. 13 shows possible modifications of the system, using a radiation source to ionize air in the path of firing in a sequence of burst that can be directed 3 dimensionally by the meeting of combined energy pulses. A rapid firing of these heated coordinated may trace a trajectory for the electric path. The trajectory may even be curved.

Ionic Fluid Details

Gel like medium solution can be made from a combination of ionic solutions and a gelatinous substance:

Hereinbelow is a list of some possible conductive solution and metallic conductive powder Conductive Molecule (Electrical conductivity in mS/cm at 0.5% mass concentration and 0% gelatinous substance)

| | | |
|---|---|---|
| Ammonium chloride | NH4 Cl | 10.5 |
| Ammonium sulfate | (NH4)2SO4 | 7.4 |
| Barium chloride | BaCl2 | 4.7 |
| Calcium chloride | CaCl2 | 8.1 |
| Hydrogen chloride | HCl | 45.1 |

-continued

| | | |
|---|---|---|
| Lithium chloride | LiCl | 10.1 |
| Magnesium chloride | MgCl2 | 8.6 |
| Nitric acid | HNO3 | 28.4 |
| Oxalic acid | H2C2O4 | 14.0 |
| Phosphoric acid | H3PO4 | 5.5 |
| Potassium bromide | KBr | 5.2 |
| Potassium carbonate | K2CO3 | 7.0 |
| Potassium chloride | KCl | 8.2 |
| Potassium hydroxide | KOH | 20.0 |
| Potassium sulfate | K2SO4 | 5.8 |
| Sodium bromide | NaBr | 5.0 |
| Sodium carbonate | Na2CO3 | 7.0 |
| Sodium chloride | NaCl | 8.2 |
| Sodium hydroxide | NaOH | 24.8 |
| Sodium nitrate | NaNO3 | 5.4 |
| Sodium phosphate | Na3PO4 | 7.3 |
| Sodium sulfate | Na2SO4 | 5.9 |
| Strontium chloride | SrCl2 | 5.9 |
| Sodium thiosulfate | Na2S2O3 | 5.7 |
| Sulfuric acid | H2SO4 | 24.3 |
| Trichloroacetic acid | CCl3COOH | 10.3 |

The following metallic powders enhance conductivity when in suspension

| | | |
|---|---|---|
| Silver, | Copper, | Carbon, |
| Aluminum, | Bismuth, | Tin |

Listed below are possible variable viscosity substance

| | | |
|---|---|---|
| Gelatin, | Collagen | Petroleum based gel |
| Rose's metal | Cerrosafe | Wood's metal |
| Field's metal | Cerrolow 136 | Corrolo 117 |
| Bi—Pb—Sn—Cd—Ln—Ti | | |

Gas Generation Details

Listed below are some possible chemical reaction for pressurized gas generation

Hydrogen peroxide (with catalyst: silver mesh, iron, copper, zinc)

Nitrous oxide (with catalyst)

Angle Determination and Target Acquisition

The computed angle can be worked out to the difference between 90 degrees and the inverse tangent of the ratio of distance between the 2 beams and target distance. The dielectric breakdown component can be accounted for by projecting the breakdown distance with the same angular ration and subtracting that from the distance.

Figure 14:
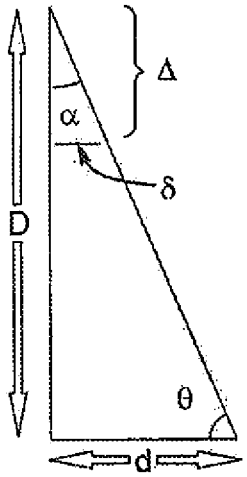
FIG. 14 is schematic representation of a geometry for target meeting of converging beams of the electric projection weapon system, in accordance with an embodiment.

FIG. 14 shows a geometry for target meeting of converging beams. In FIG. 14 "d" is the distance between the two firing jets "D" the intersection distance to the target, "α" is the angle between to joining beams and "θ" the computer controlled angle for firing. Where δ is the dielectric breakdown distance and Δ is the distance correction to the target. Then it can be easily derived that θ is:

$$\theta_o = 90^\circ - \left[\tan^{-1}\left(\frac{d}{D}\right)\right]$$

Then we note that the practical measured distance to the target is actually 1 and not D where 1=D−Δ.

We also know that Δ/δ=D/d, thus $$\Delta = \frac{\delta}{\tan(90-\theta)} \text{ Therefore, } \theta = 90 - \tan^{-1}\left[\frac{\delta}{l + \left(\frac{\delta}{\tan(90-\theta)}\right)}\right]$$

From the above equation θ can be discovered numerically by iteration plugging $\theta_o$. As a first approximation. 3 or 4 polynomial McLaurin approximations can be worked out for trigonometric estimation that are accurate enough for precise angle stepping. As distance increase is becomes more important to improve finesse in step control of the jet defecting mechanism.

The depth of the firing is computed based on the position of the target such that a arching distance occurs on the target in this case breakdown is computed from the ratio of D/d Magnetic arc Propulsion Mechanisms Consider the following setup of a classic rolling bar experiment in physics. In this paradigm however, the rolling bar is replaced with an electric arc. This arc may be further seeded with ionic solutions, solids or gases creating a plasma.

Figure 15:
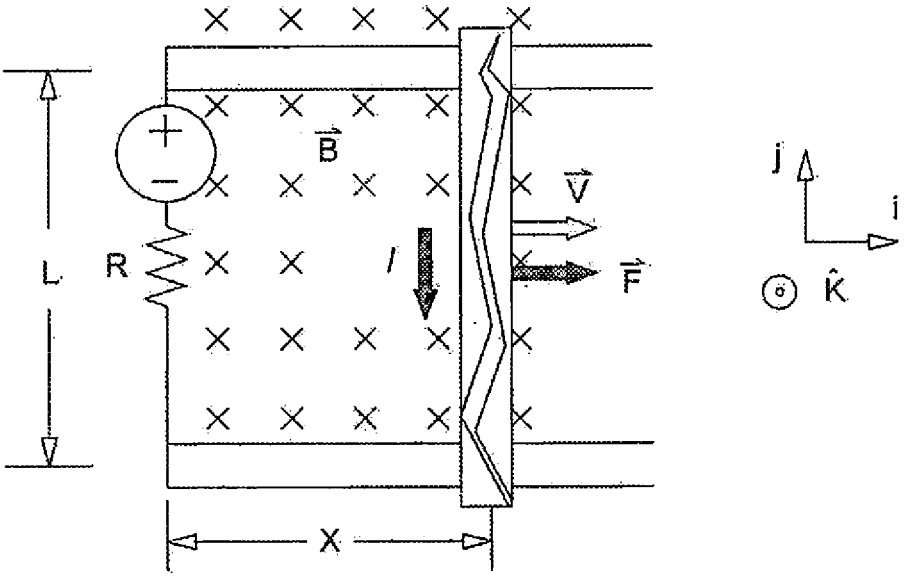
FIG. 15 is a schematic representation of a propulsion mechanism, in accordance with an embodiment.

Referring to FIG. 15, an embodiment where the rolling bar is replaced by an electric arc is shown. Hence, the ions in the arc plasma can be propelled according to the generated force. In this case the metallic conductor can be substituted with a plasma that is propelled by a high energy magnetic pulse, making use of Lorentz's force law and a constant current HV source. In effect there is therefore a MHD propelled arc. In the diagram of FIG. 15, L is the current arc path length, I is the current B creating the magnetic field and F the resulting force acting on ionic entities.

As current flows in the corona arc, the generated plasma will be subject to the Lorentz force as described below and the electrons or plasma are propelled according to the Lorentz force equations which is:

$$F_L = n \cdot q \cdot \underset{v}{\rightarrow} x \underset{B}{\rightarrow}$$

Which can be expressed in terms of the plasma current and arc path length as:

$$F_L = I_p \underset{L}{\rightarrow} x \underset{B}{\rightarrow}$$

Where Ip is the plasma current, L is the current path length vector and B would be the magnetic field vector produced by an electromagnet. In such a case then, from Ampere's law the magnetic field of the electromagnet can be worked out to be:

$$\underset{B}{\rightarrow} = p_o \cdot p_r \cdot N \cdot I_M$$

Where $I_M$ is the current through the electomagent plugging back then we have:

$$a_e = \frac{(\underset{L}{\rightarrow} \cdot I_P) x (\mu_o \cdot \mu_r \cdot N \cdot I_M)}{m_e}$$

Where Ip is:

$$I_p = I_{source} - I_{ind}$$

For computing the current special case we are interested in, is based on the empirical observations known as Lenz's law (Heinrick Lenz 1834). This is a special case of Faraday's equation, Lenz's states that:

$$\varepsilon_{ind} = -\frac{d\Phi_B}{dt} = -B \cdot L \cdot v \text{ And thus } I_{ind} = \frac{-B \cdot L \cdot v}{R}$$

By substituting in the above we have that $$a_e = \frac{(\vec{L} \cdot \left\{ I_{source} \frac{-B \cdot L \cdot v}{R} \right\}) x (\mu_o \cdot \mu_r \cdot N \cdot I_M)}{m_e}$$

By rearranging the terms and expressing acceleration and velocity in terms of displacement it is possible to show that:

$$m_e \cdot \frac{d^2x}{dt^2} + L \cdot (\mu_o \cdot \mu_r \cdot N \cdot I_M)^2 \cdot \frac{dx}{dt} - L \cdot I_{source} = 0$$

Which is a second order homogeneous differential equation. The systems can then be tune for overdamped, damped or underdamped response. Note that ionic collision dynamics should be used to further refine this model. As an approximation very large accelerations can be present. The system is in essence an MHD plasma propulsion in which the plasma also carries (charge) electricity By modulating the magnetic field in the above setup; it would be possible to project an ionic stream in the forward direction. This stream can then either deflect the current path L through the air or be utilized in pairs of ionized plasma channels that then provide a low impedance path for electric arcing. Ionic columns can be formed in this way and then paired can be used to join at a target point and serve as a path for yet another high voltage supply electrifying the so defined path.

Experiments and Prototypes

FIGS. 16A to 16J show images of different components of the electric projection weapon system which have been used during experiments leading to the above described electric projection weapon system and during the construction of prototypes thereof.

Figure 16A:
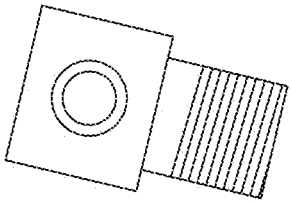
FIG. 16A is an image showing an isometric view of a custom bottle orifice insert for compressed air inlet test of the electric projection weapon system, in accordance with an embodiment.

FIG. 16A shows a custom bottle orifice insert for compressed air inlet test.

Figure 16B:
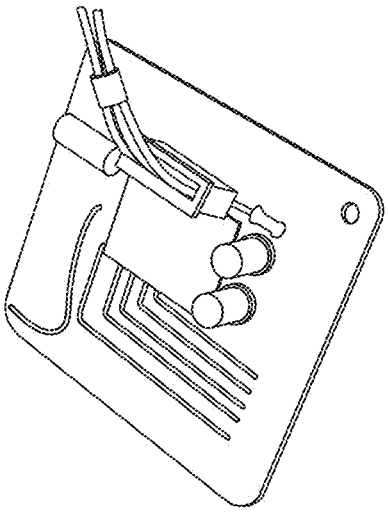
FIG. 16B is an image showing an isometric view of a motor control for tangential aiming device of the electric projection weapon system, in accordance with an embodiment.

FIG. 16B shows a motor control for tangential aiming device being prepared for testing.

Figure 16C:
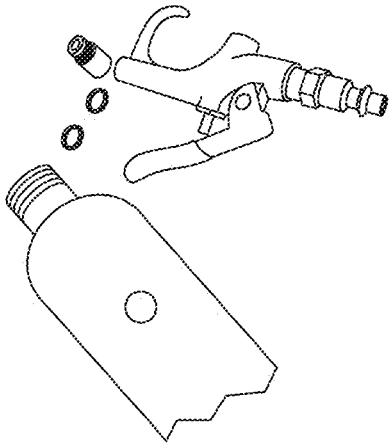
FIG. 16C is an image showing an isometric view of a metal bottle with custom bottle orifice and blow gun with gaskets for the electric projection weapon system, in accordance with an embodiment.

FIG. 16C shows a metal bottle with custom bottle orifice and blow gun with gaskets being readied for assembly.

Figure 16D:
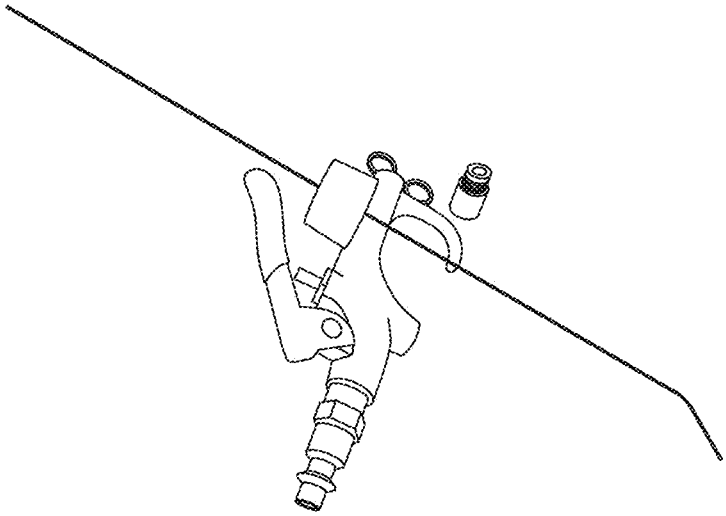
FIG. 16D is an image showing an isometric view of an hypodermic laminar tubing nozzle for the electric projection weapon system, in accordance with an embodiment.

FIG. 16D shows a hypodermic laminar tubing nozzle for use with parts shown in the above Figures.

Figure 16E:
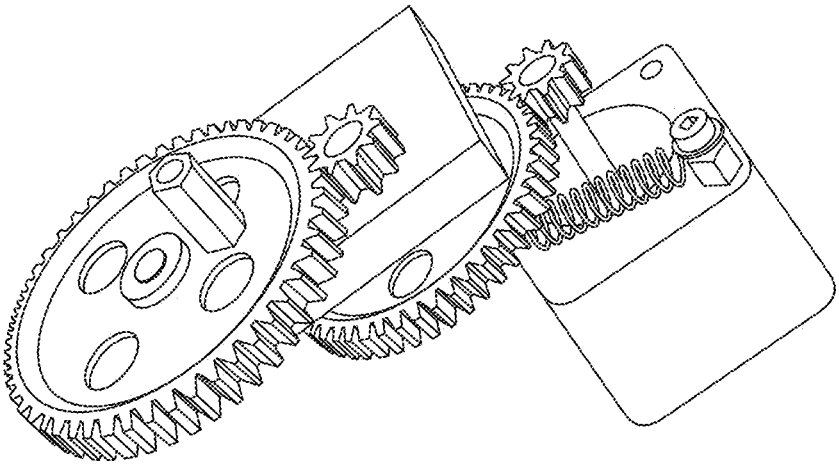
FIG. 16E is an image showing an isometric view of a gear head assembly for decoupling of stepper motor of aiming device of the electric projection weapon system, in accordance with an embodiment.

FIG. 16E shows a gear head assembly which can be used for factor 20 decoupling of stepper motor for aiming device. In an embodiment the gear head assembly can provide ~0.5° precision with 640 steps per revolution, using a resolution of 32 micro-steps. A sharpie pen (blue) is shown in the foreground for scale. This provides the nozzle deflection required for arcing control.

Figure 16F:
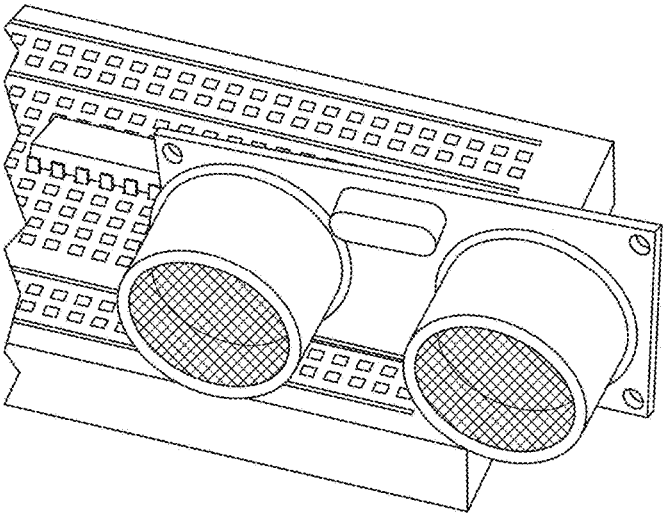
FIG. 16F is an image showing an isometric view of a test on an automatic target range finder based on ultrasonic reflection for the electric projection weapon system, in accordance with an embodiment.

FIG. 16F shows a test on an automatic target range finder base on ultrasonic reflection.

Figure 16G:
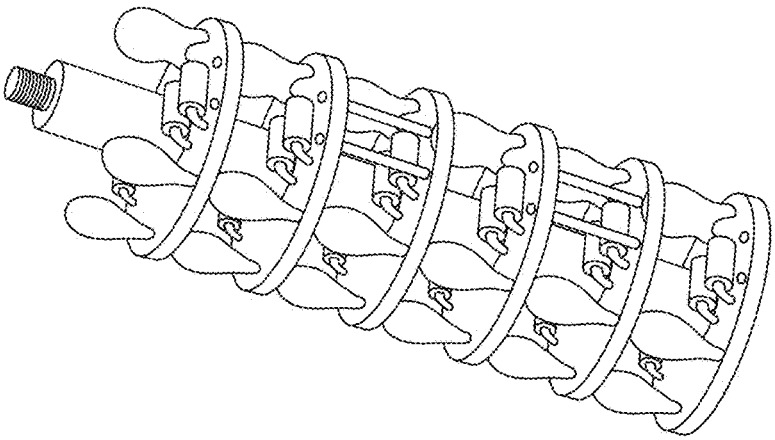
FIG. 16G is an image showing an isometric view of a high voltage generator stack of a Walton Cockroft multiplier circuit for the electric projection weapon system, in accordance with an embodiment.

FIG. 16G shows a high voltage generator stack of a Walton Cockroft multiplier circuit with 4 stages per stack for a total of 26 stages and which can achieve upwards of 50 kV.

Figure 16H:
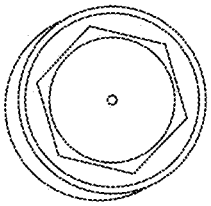
FIG. 16H is an image showing a top plan view of a brass machined nozzle for the electric projection weapon system, in accordance with an embodiment.

FIG. 16H shows a brass machined nozzle from modified fitting provides increased laminar distance in preliminary testing.

Figure 16I:
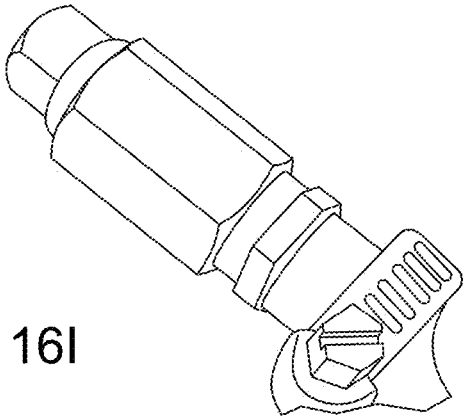
FIG. 16I is an image showing a side view of the brass machined nozzle of FIG. 16H.
Figure 16J:
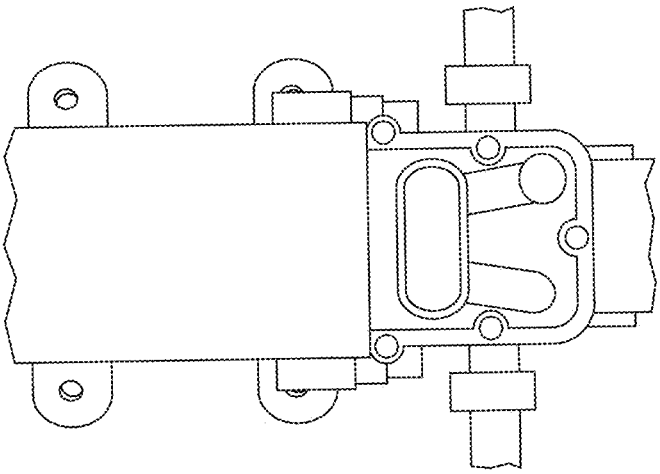
FIG. 16J is an image showing a top plan view of a pump for the electric projection weapon system, in accordance with an embodiment.

FIG. 16I shows the brass machined nozzle from modified fitting of FIG. 16H with further details FIG. 16J shows a special pump used to achieve 9 ATM or approximately 130 psi pressure.

What is claimed is:

1. An electric projection weapon system for projecting conductive fluid beams towards a target, the electric projection weapon system comprising:

a positioning system for determining a focal point near or on the target;

at least two nozzles configured to project the conductive fluid beams towards the focal point, at least one of the nozzles being actuated by a nozzle actuator and being directionally controlled to have the conductive fluid beams converge towards the focal point;

isolated pressurized reservoirs in fluid communication with the at least two nozzles and containing a high-conductance ionic solution forming the fluid beams when projected from the at least two nozzles; and a high voltage power supply applying a potential difference between the conductive fluid beams.

2. The electric projection weapon system of claim 1, wherein the at least two nozzles include laminar flow nozzles.

3. The electric projection weapon system of claim 1, wherein the positioning system comprises a range finder acquiring a position of the target relative to the electric projection weapons system, a directional position of the at least one of the nozzles actuated by the nozzle actuator being set according to the acquired position of the target, to provide convergence of the conductive fluid beams at the focal point, corresponding to the target position.

4. The electric projection weapon system of claim 3, wherein the range finder acquires a target distance to the target and wherein an angle between the conductive fluid beams projected by two of the at least two nozzles is determined by a difference between 90 degrees and an inverse tangent of a ratio of a distance between the two beams and the target distance.

5. The electric projection weapon system of claim 1, wherein the isolated pressurized reservoirs are pressurized using a pump.

6. The electric projection weapon system of claim 1, wherein the isolated pressurized reservoirs are pressurized using one of a piston or a bladder.

7. The electric projection weapon system of claim 1, comprising sensors to detect humidity, temperature and pressure and a controller to determine a current dielectric breakdown of air and wherein the voltage applied by the high voltage power supply is modulated according to the current dielectric breakdown of air.

8. The electric projection weapon system of claim 1, further comprising a viscosity control subsystem maintaining the high-conductance ionic solution inside the isolated pressurized reservoirs at a higher temperature than the ambient temperature outside of the electric projection weapon system, to produce a quasi or total phase-to-solid change of the high-conductance ionic solution, as it is projected from the at least two nozzles.

9. The electric projection weapon system of claim 8, wherein the viscosity control subsystem includes a temperature control loop including external thermal sensors, internal thermal sensors and an internal heater for maintaining the isolated pressurized reservoirs at higher temperature than ambient temperature.

10. The electric projection weapon system of claim 8, wherein the viscosity control subsystem includes nozzle cooling elements to cool the at least two nozzles, for cooling the high-conductance ionic solution flowing therethrough.

11. The electric projection weapon system of claim 1, wherein the nozzle actuator controls the direction of the at least one nozzle for converging the conductive fluid beams at a focal point located forward of the target.

12. The electric projection weapon system of claim 1, comprising a sequential valve system that electrically isolate the isolated pressurized reservoirs one from the other(s) prior to applying a high potential voltage to one the nozzles, and control flow output of the high-conductance ionic solution from the isolated pressurized reservoirs.

13. The electric projection weapon system of claim 1, wherein the positioning system includes a controller calculating an angle at which the at least one nozzle needs to be moved for the conductive fluid beams to converge at the focal point.

14. The electric projection weapon system of claim 1, wherein the high-conductance ionic solution has an electrical conductivity at 0.5% mass concentration between 4 and 45 mS/cm.

15. The electric projection weapon system of claim 8, wherein the high-conductance fluid beams comprises a gelatinous substance.

16. The electric projection weapon system of claim 1, wherein the positioning system is part of a targeting system.

17. The electric projection weapon system of claim 1, wherein the positioning system determines a plurality of additional focal points along a plane, and wherein the nozzle actuator sequentially moves the at least one nozzle to have convergence of the conductive fluid beams at said additional focal points, creating a rastered electric wall.

18. An electric projection weapon system for projecting conductive fluid beams towards a target, the electric projection weapon system comprising:

a positioning system for determining a focal point, frontward or on the target;

a first nozzle for projecting a first conductive fluid beam toward the focal point;

a second nozzle configured to project a second conductive fluid beam;

a nozzle actuator moving the second nozzle to control a path of the second conductive fluid beam such that it intersects a path of the first conductive fluid beam, near or at the focal point;

first and second isolated pressurized reservoirs in fluid communication with the first and second nozzles and containing a high-conductance ionic solution forming the first and second fluid beams when projected from the nozzles; and a high voltage power supply applying a potential difference between the first and second conductive fluid beams, to have an electric current circulate between the conductive fluid beams.

19. The electric projection weapon system of claim 16, wherein the first nozzle is fixed.

20. The electric projection weapon system of claim 16, comprising a second nozzle actuator for moving the first nozzle relative to the second nozzle.

21. The electric projection weapon system of claim 16, comprising a controller to determine an angle between the first and second nozzle to have the first and second conductive fluid beams converge at or near the focal point.

* * * * *